US011262064B1

(12) United States Patent
Boyd

(10) Patent No.: US 11,262,064 B1
(45) Date of Patent: Mar. 1, 2022

(54) WRIST LIGHT SYSTEM AND METHOD OF USE

(71) Applicant: Michael Boyd, Arlington, TX (US)

(72) Inventor: Michael Boyd, Arlington, TX (US)

( * ) Notice: Subject to any disclaimer, the term of this patent is extended or adjusted under 35 U.S.C. 154(b) by 63 days.

(21) Appl. No.: 16/362,143

(22) Filed: Mar. 22, 2019

Related U.S. Application Data

(60) Provisional application No. 62/646,395, filed on Mar. 22, 2018.

(51) Int. Cl.
*F21V 33/00* (2006.01)
*A44C 5/00* (2006.01)
*F21Y 115/10* (2016.01)

(52) U.S. Cl.
CPC ..... *F21V 33/0008* (2013.01); *A44C 5/0007* (2013.01); *F21Y 2115/10* (2016.08)

(58) Field of Classification Search
None
See application file for complete search history.

(56) References Cited

U.S. PATENT DOCUMENTS 10,175,653 B1 * 1/2019 Bloom ..... G04G 17/08
2011/0310592 A1 * 12/2011 Smith ..... F21L 4/00 362/103
2012/0051033 A1 * 3/2012 Starogiannis ..... F21L 4/04 362/103
2012/0253485 A1 * 10/2012 Weast ..... G06F 1/163 700/91
2013/0110264 A1 * 5/2013 Weast ..... G06F 19/3481 700/91
2013/0226486 A1 * 8/2013 Henderson ..... G01R 31/367 702/63
2014/0049946 A1 * 2/2014 Schrimmer ..... F21V 33/0008 362/103
2015/0157220 A1 * 6/2015 Fish ..... A61B 5/02055 600/301
2015/0287338 A1 * 10/2015 Wells ..... G09B 19/0038 702/19
2016/0324470 A1 * 11/2016 Townsend ..... G06F 1/163
2018/0184920 A1 * 7/2018 Rabinovich ..... A61B 5/02438
2019/0033787 A1 * 1/2019 Swanagin ..... F21L 4/02
2019/0116942 A1 * 4/2019 Allan ..... A44C 5/0007

* cited by examiner

*Primary Examiner* — Britt D Hanley
(74) *Attorney, Agent, or Firm* — Leavitt Eldredge Law Firm

(57) ABSTRACT

A wrist band system includes a body having a first strap integral with a second strap, the first strap and the second strap joining at a top face and having a side face; an opening extending through the thickness of the top face a housing extending from an outer surface of the first strap, the housing having a port; a plurality of lights secured to the side face; and a power source disposed within the body and conductively coupled to both the port and the plurality of lights.

1 Claim, 3 Drawing Sheets

WRIST LIGHT SYSTEM AND METHOD OF USE

BACKGROUND

1. Field of the Invention

The present invention relates to a wrist light system and method of use.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
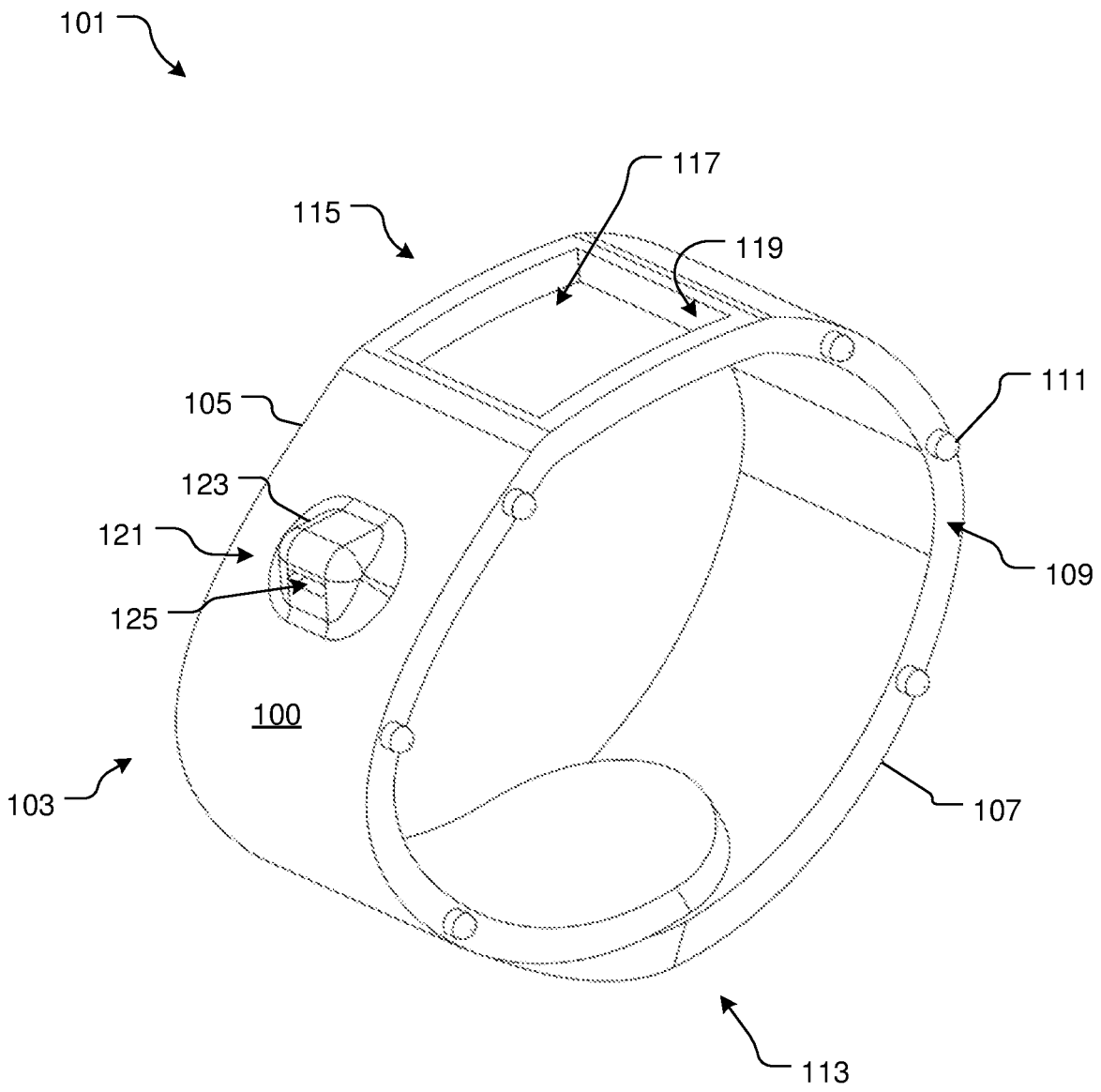
FIG. 1 is an oblique view of the LED wrist band system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
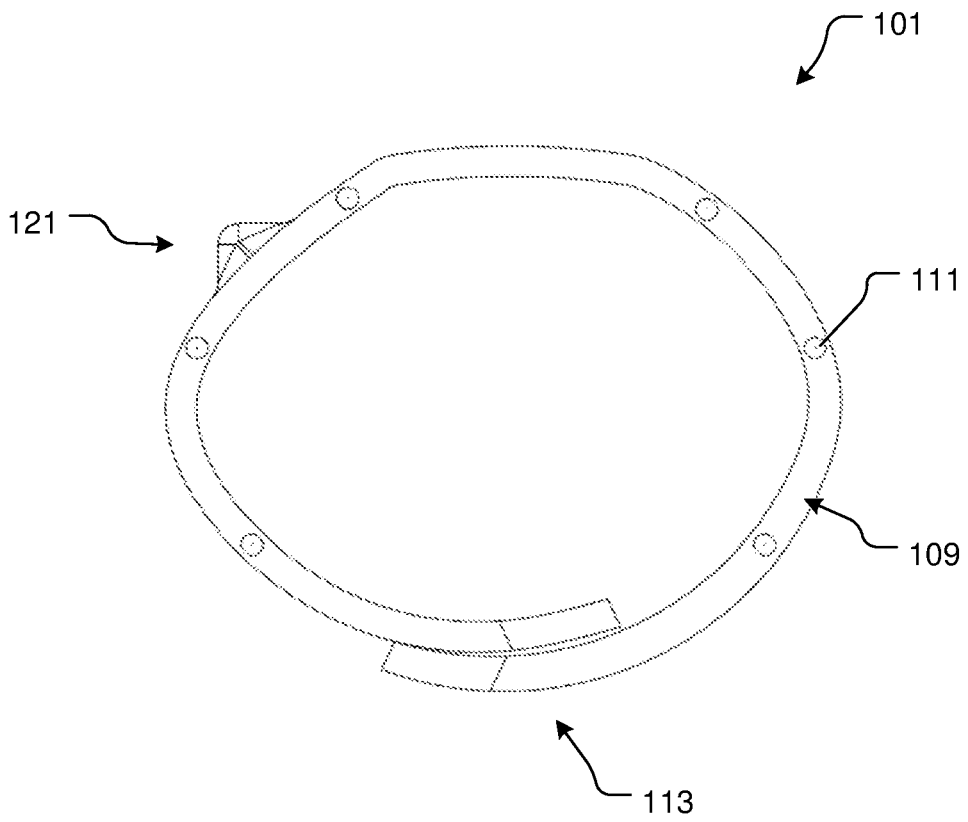
FIG. 2 is a side view of the system of FIG. 1.
Figure 3:
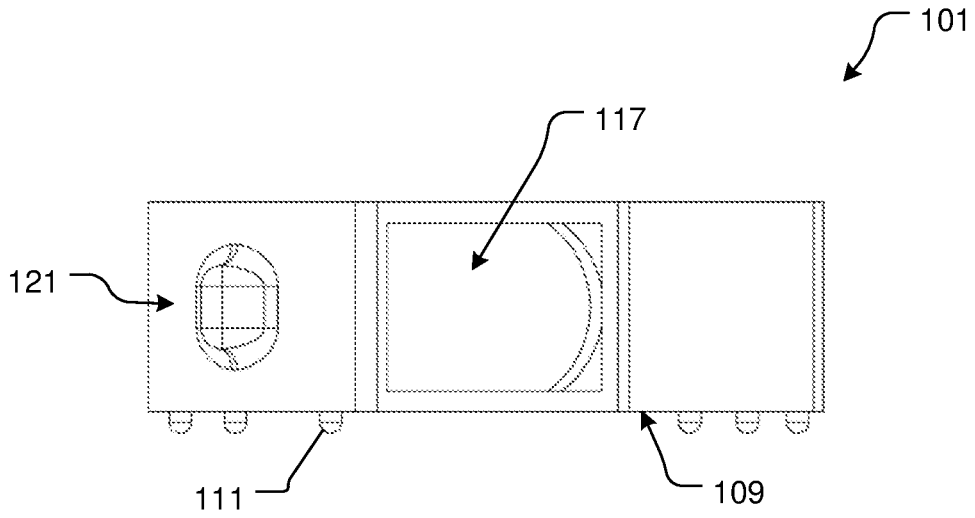
FIG. 3 is a top view of the system of FIG. 1.
Figure 4:
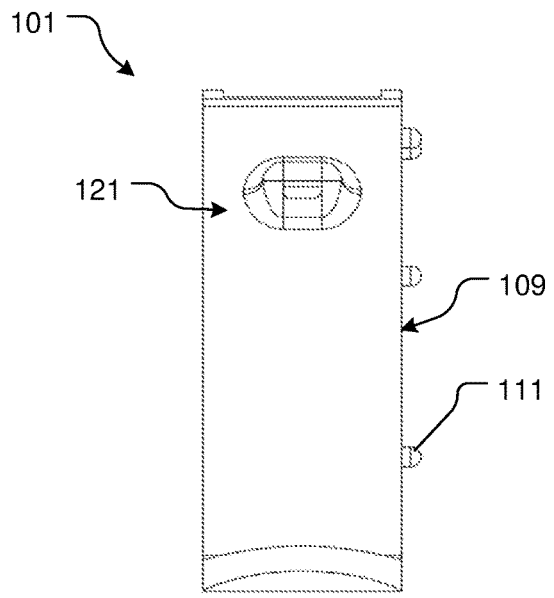
FIG. 4 is a front view of the system of FIG. 1.
Figure 5:
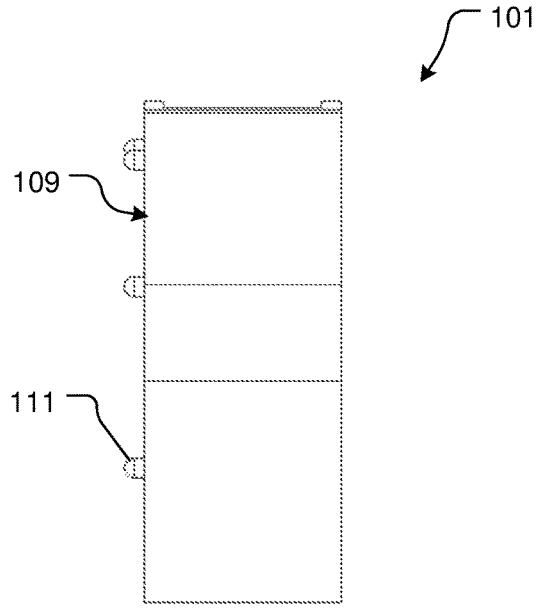
FIG. 5 is a back view of the system of FIG. 1.
Figure 6:
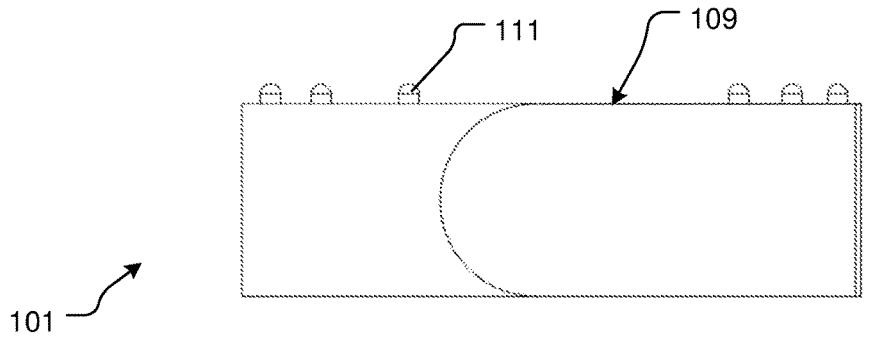
FIG. 6 is a bottom view of the system of FIG. 1.

Referring now to the drawings wherein like reference characters identify corresponding or similar elements throughout the several views, FIGS. 1-3 depict various embodiments of system and method of use in accordance with the preferred embodiment of the present invention. It should be understood that the embodiments discussed herein are substantially similar in form and function and share one or more of the features discussed in each embodiment although the features may not be shown specifically with reference to the particular embodiment.

As shown in the drawings, the present invention is related to a wrist light that comprises of a body with a plurality of lights secured thereto. The light assembly will preferably consist of at least 6 LED lights spread evenly around a band body and secured to a power source, e.g., a battery and a switch. It will be appreciated that the light assembly can be powered by a standard watch battery, a rechargeable battery, and/or other suitable means. It one contemplated embodiment, the power source is charged by a standard USB power plug.

In one preferred embodiment, the band can be composed of a rubber, silicon, leather, cloth, metal and/or similar suitable materials. The band could be adjustable in length to accommodate different wrist sizes in addition to having surfaces for indicia, logos, pictures, and the like.

The present invention will allow the user to work on any project hands free with constant light no matter which direction of hand movement.

Referring now FIGS. 1-6, various views of a wrist band system 101 is shown having a body 103 with two straps 105, 107 configured to wrap around the wrist of the user and joined together via a fastener 113. The body is further provided with a side surface 109 wherein a plurality of lights 111 extend therefrom. The lights are conductively coupled to power source disposed within body 103. The system could also include an on/off switch configured to activate the plurality of lights. In one embodiment, the lights are LED lights; however, alternative embodiments could include different types of lights.

System 101 further includes an opening 117 that extends through a thickness of the body about a top face 115. The opening 117 could be utilized to secure an object therein via surface 119; for example, a watch, tool, and so forth. A housing 121 has a body 123 and extends from surface 100 of the body 103. The housing forms a cavity for storing one or more devices therein, e.g., an access port, light, and so forth. In one embodiment, the housing 121 could include a port 125 conductively coupled to a battery disposed within the body 103 and configured to enable conductive coupling to the battery to an outside source, e.g., a USB power cord.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A wrist band system, comprising:

a body, having:

a first strap integral with a second strap, the first strap and the second strap joining at a top face and having a side face;

an opening extending through the thickness of the top face;

a housing extending from an outer surface of the top face of the first strap, the housing forming a hollow cavity and a port opening in communication with the cavity; and an electrical port positioned within the cavity and in communication with the port opening;

a plurality of lights secured to the side face; and a power source disposed within the housing and conductively coupled to both the electrical port and the plurality of lights;

wherein the power source powers the plurality of lights;

wherein the housing provides means for recharging the power source via the electrical port in communication with the port opening.

* * * * *